US011719259B2

(12) United States Patent
Rice

(10) Patent No.: US 11,719,259 B2
(45) Date of Patent: Aug. 8, 2023

(54) MOUNT BRACKET FOR FAN

(71) Applicant: Hunter Fan Company, Memphis, TN (US)

(72) Inventor: Daniel Rice, Thompson's Station, TN (US)

(73) Assignee: Hunter Fan Company, Memphis, TN (US)

( * ) Notice: Subject to any disclaimer, the term of this patent is extended or adjusted under 35 U.S.C. 154(b) by 165 days.

(21) Appl. No.: 17/345,375

(22) Filed: Jun. 11, 2021

(65) Prior Publication Data

US 2022/0003245 A1 Jan. 6, 2022

Related U.S. Application Data

(60) Provisional application No. 63/046,775, filed on Jul. 1, 2020.

(51) Int. Cl.

| | |
|---|---|
| ***F04D 29/64*** | (2006.01) |
| ***F04D 29/60*** | (2006.01) |
| ***F04D 25/08*** | (2006.01) |
| ***F21V 33/00*** | (2006.01) |
| ***F04D 29/00*** | (2006.01) |

(Continued)

(52) U.S. Cl.

CPC ..... *F04D 29/646* (2013.01); *F04D 25/08* (2013.01); *F04D 29/005* (2013.01); *F04D 29/601* (2013.01); *F04D 29/703* (2013.01); *F21V 33/0096* (2013.01); *F04D 19/002* (2013.01); *F21V 21/00* (2013.01); *F21V 21/30* (2013.01)

(58) Field of Classification Search

CPC ..... F04D 19/002; F04D 25/08; F04D 29/005; F04D 29/601; F04D 29/646; F04D 29/703; F21V 21/00; F21V 21/30; F21V 33/0096; F21V 21/08; F21V 21/088; F21V 21/145

See application file for complete search history.

(56) References Cited

U.S. PATENT DOCUMENTS 4,973,016 A 11/1990 Hertenstein
5,772,166 A * 6/1998 Adams ..... F21V 21/08 248/229.16

(Continued)

FOREIGN PATENT DOCUMENTS

KR 20160118057 A * 10/2016 ..... F04D 25/08

OTHER PUBLICATIONS

Bigassfans, "Aireye Occupancy Sensor", Owners Manual, 4 pages, Lexington, KY.

*Primary Examiner* — Brian P Wolcott
*Assistant Examiner* — Jesse M Prager
(74) *Attorney, Agent, or Firm* — McGarry Bair PC

(57) ABSTRACT

A fan can include a motor for driving a set of blades to move a volume of air about a space. A cage can be provided to encase the set of blades to protect the fan, as well as permit a volume of air to move through the cage. A mount bracket couples to the cage, and can include a first portion including a first pair of hooks connecting the first portion to the cage, with the first portion including a pair of apertures and an attachment feature, and a second portion including a second pair of hooks connecting the first portion to the cage, with the second portion including a pair of extensions configured to secure to the first portion at the pair of apertures. The attachment feature is configured to couple an accessory to the cage via the mount bracket.

21 Claims, 6 Drawing Sheets

(51) Int. Cl.

| | |
|---|---|
| ***F04D 29/70*** | (2006.01) |
| ***F04D 19/00*** | (2006.01) |
| ***F21V 21/00*** | (2006.01) |
| ***F21V 21/30*** | (2006.01) |

(56) References Cited

U.S. PATENT DOCUMENTS

| | | | | |
|---|---|---|---|---|
| 5,845,983 | A * | 12/1998 | Schmidt | B60Q 1/0483 362/523 |
| 6,357,707 | B1 * | 3/2002 | Lindsay | B60Q 1/305 362/523 |
| D827,583 | S | 9/2018 | Oleson | |
| 2005/0260943 | A1 | 11/2005 | Snyder et al. | |

* cited by examiner

MOUNT BRACKET FOR FAN

CROSS-REFERENCE TO RELATED APPLICATION(S)

This application claims priority to and the benefit of U.S. Provisional Patent Application No. 63/046,775, filed Jul. 1, 2020, the entirety of which is incorporated herein by reference.

TECHNICAL FIELD

This invention and disclosure relates to the field of fans for moving a volume of air about a space. More specifically, the disclosure relates to a bracket for a fan for mounting accessories to a cage surrounding the fan protecting fan blades.

BACKGROUND

Fans, such as table fans, floor fans, or other portable fans, include blades for driving a volume of air about a space, such as a room. The blades are encased and protected by an exterior cage. The cage, in some examples, can include a two-piece assembly, such as a front cage and a rear cage which are connected where the two meet, encasing the blades. The cage can include a set of circumferential bars, which increase in circumference as they extend outwardly in order to encase the spinning blades. A set of ribs can be connected to the bars to stabilize and secure the bars, further defining the cage.

BRIEF DESCRIPTION

In one aspect, the disclosure relates to a mount bracket for mounting an accessory to a fan having a cage, the mount bracket comprising: a first portion including at least one aperture and a first connector for connecting the first portion to the cage; a second portion including a second connector for connecting the second portion to the cage, and including at least one extension complementary to the at least one aperture; wherein the first portion couples to the cage with the first connector, the second portion couples to the cage with the second connector, and the first portion couples to the second portion with the at least one extension extending through the at least one aperture.

In another aspect, the disclosure relates to a fan comprising: a motor assembly; a set of blades rotatably driven by the motor assembly to move a volume of air about a space; a cage encasing the set of blades, the cage including a set of ribs and a set of bars; and a mount bracket coupled to the cage, the mount bracket comprising: a first portion including a first pair of hooks connecting the first portion to the cage, with the first portion including a pair of apertures and an attachment feature, and a second portion including a second pair of hooks connecting the first portion to the cage, with the second portion including a pair of extensions configured to secure to the first portion at the pair of apertures; wherein the attachment feature is configured to couple an accessory to the cage via the mount bracket.

In yet another aspect, the disclosure relates to a method of connecting an accessory to a fan with a mount bracket, the method comprising: attaching a first portion to a cage of the fan, by connecting a first pair of hooks on the first portion to a rib of the cage; attaching a second portion to the cage of the fan, by connecting a second pair of hooks on the second portion to a different rib of the cage; securing the first portion to the second portion; and securing the accessory to an attachment feature extending from the first portion.

DETAILED DESCRIPTION

Figure 1:
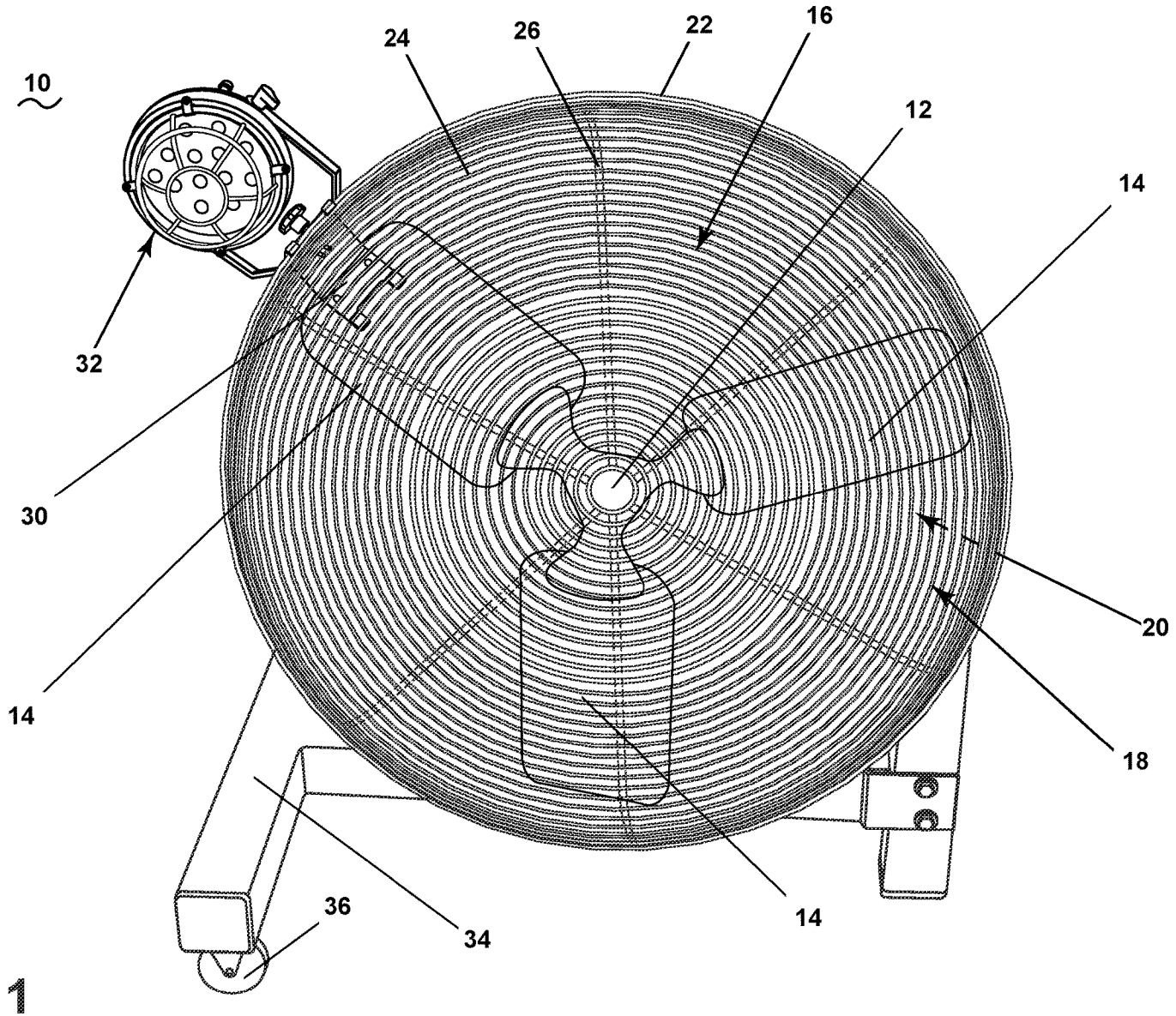
FIG. 1 is view of a fan including a cage with a light element mounted to the cage with a bracket.

The disclosure provided herein relates to a bracket for fans including cages or similar types of protective coverings or casings. More specifically, the disclosure relates to a bracket for attaching accessories to the fan at the cage of the fan.

All directional references (e.g., radial, axial, proximal, distal, upper, lower, upward, downward, left, right, lateral, front, back, top, bottom, above, below, vertical, horizontal, clockwise, counterclockwise, upstream, downstream, forward, aft, etc.) are only used for identification purposes to aid the reader's understanding of the present disclosure, and do not create limitations, particularly as to the position, orientation, or use of aspects of the disclosure described herein. Connection references (e.g., attached, coupled, connected, and joined) are to be construed broadly and can include intermediate members between a collection of elements and relative movement between elements unless otherwise indicated. As such, connection references do not necessarily infer that two elements are directly connected and in fixed relation to one another. The exemplary drawings are for purposes of illustration only and the dimensions, positions, order and relative sizes reflected in the drawings attached hereto can vary. As used herein, the term "set" or a "set" of elements can be any number of elements, including only one. For example, a set of grommets or a set of blades as used herein can include one or more grommets, or one or more blades.

Referring to FIG. 1, a fan 10 includes a motor assembly 12 coupled to a set of blades 14. The motor assembly 12 drives the blades 14 to move a volume of air about a space, such as a room, building, or even outdoor space. A cage 16 encases and protects the blades 14, while permitting movement of air through the cage 16. The cage 16 can be two-part, for example, including a front portion 18 and a rear portion 20, which can be connected together at outer edges 22 to surround the blades 14. The cage 16 can include a set of circumferentially extending bars 24, interconnected with a set of ribs 26. It should be appreciated that the particular structure of the cage 16 can vary, and should not be limited by that shown herein, and that a myriad of cage designs or geometries are contemplated.

A mount bracket 30 couples to the cage 16. The mount bracket 30 can provide for attaching an accessory 32 to the cage 16, such as a light in one non-limiting example. The mount bracket 30 can be mounted at any circumferential position permitted by the fan 10.

Additionally, the fan 10 can include a stand 34. The stand 34 includes a structure for supporting the fan 10. Additionally, the stand 34 can include wheels 36 to facilitate movement of the fan 10.

Figure 2:
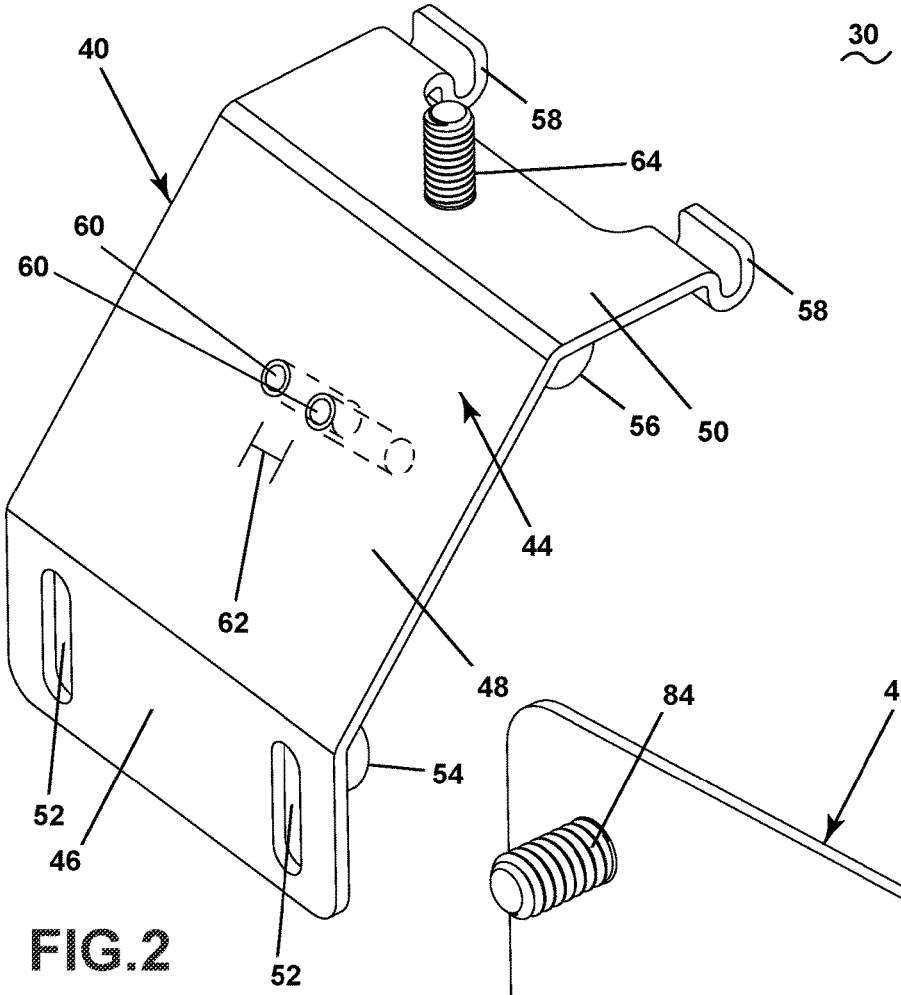
FIG. 2 is a perspective view of a first portion of the mount bracket of FIG. 1.
Figure 3:
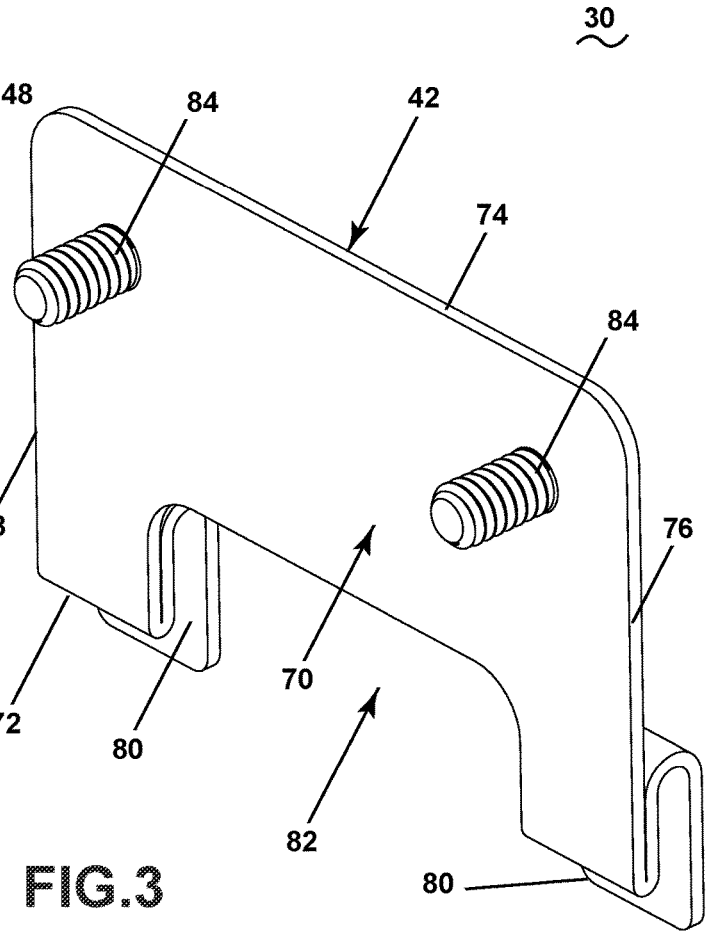
FIG. 3 is a perspective view of a second portion of the mount bracket of FIG. 1.

The mount bracket 30 can be of two-part form. FIG. 2 shows a first portion 40 and FIG. 3 shows a second portion 42, with the first and second portions 40, 42 defining the two parts of the mount bracket 30. Referring to FIG. 2, the first portion 40 includes a body 44. The body 44 can be separated into three sections as a first section 46, second section 48, and a third section 50. The three sections provide for defining a contour for the first portion 40 to generally follow the contour of the cage 16. While three planar sections are shown, a curved or curvilinear design is also contemplated.

The first section 46 includes a pair of spaced apertures 52, with the apertures 52 being elongated. The second section 48 extends between the first section 46 and the third section 50, and can be arranged at an angle 54, 56 relative to both of the first section 46 and the third section 50. The angles 54, 56 can be 45-degrees, for example, while any angle between 1-degree and 90-degrees is contemplated, such that the angles 54, 56 are acute angles. Additionally, it is contemplated that one angle 54 can be different than another angle 56, and need not be the same. The third section 50 includes a first connector, shown as a pair of spaced hooks 58 extending from the third section 50 opposite of the second section 48. The hooks 58 can be sized to attach about the bars 24 or ribs 26 of the cage 16, for example.

A pair of fixing extensions 60 extend from the second section 48. The fixing extensions 60 are shown in broken lines, as they are on the underside of the body 44. A better view of the fixing extensions 60 can be seen in FIG. 4. The pair of fixing extensions 60 can be spaced from one another by a spacing distance 62. The spacing distance 62 can be similar to or slightly larger than the thickness of the bars 24 or ribs 26, facilitating attaching of the first portion 40 to the cage 16, with the fixing extensions 60 securing movement of the mount bracket 30 about the cage 16.

Additionally, an attachment feature 64 can extend from the third section 50, opposite of the pair of fixing extensions 60. While provided on the third section 50, it should be understood that the attachment feature 64 need not be limited to the third section 50, but can be provided at any advantageous position on the body 44 of the first portion 40. The attachment feature 64 can be utilized for connecting a variety of accessories to the fan 10 via the mount bracket 30. In one example, the attachment feature 64 can be threaded, for threadably securing an accessory to the mount bracket 30. Alternate attachment features 64 are contemplated, such as a bolt, cotter pin, or snap-fit in some non-limiting examples. The attachment feature 64 can be any suitable element for connecting an accessory to the mount bracket 30.

Referring to FIG. 3, the second portion 42 includes a body 70, with opposing ends 72, 74 spaced by opposing side edges 76, 78. A second connector, shown as a second pair of hooks 80, extends from one end 72, with one hook 80 positioned along the end 72 at each of the side edges 76, 78. Additionally, a recess 82 is formed in the body 70 in the same end 72 from which the hooks 80 extend. A pair of connectors 84, shown as a pair of threaded fasteners, are connected to or mounted to the body 70. The connectors 84 can be spaced and arranged complementary to the apertures 52 on the first portion 40 of the mount bracket 30. While shown as threaded fasteners, the connectors 84 can be any suitable connector for connecting the second portion to the first portion 40.

Figure 4:
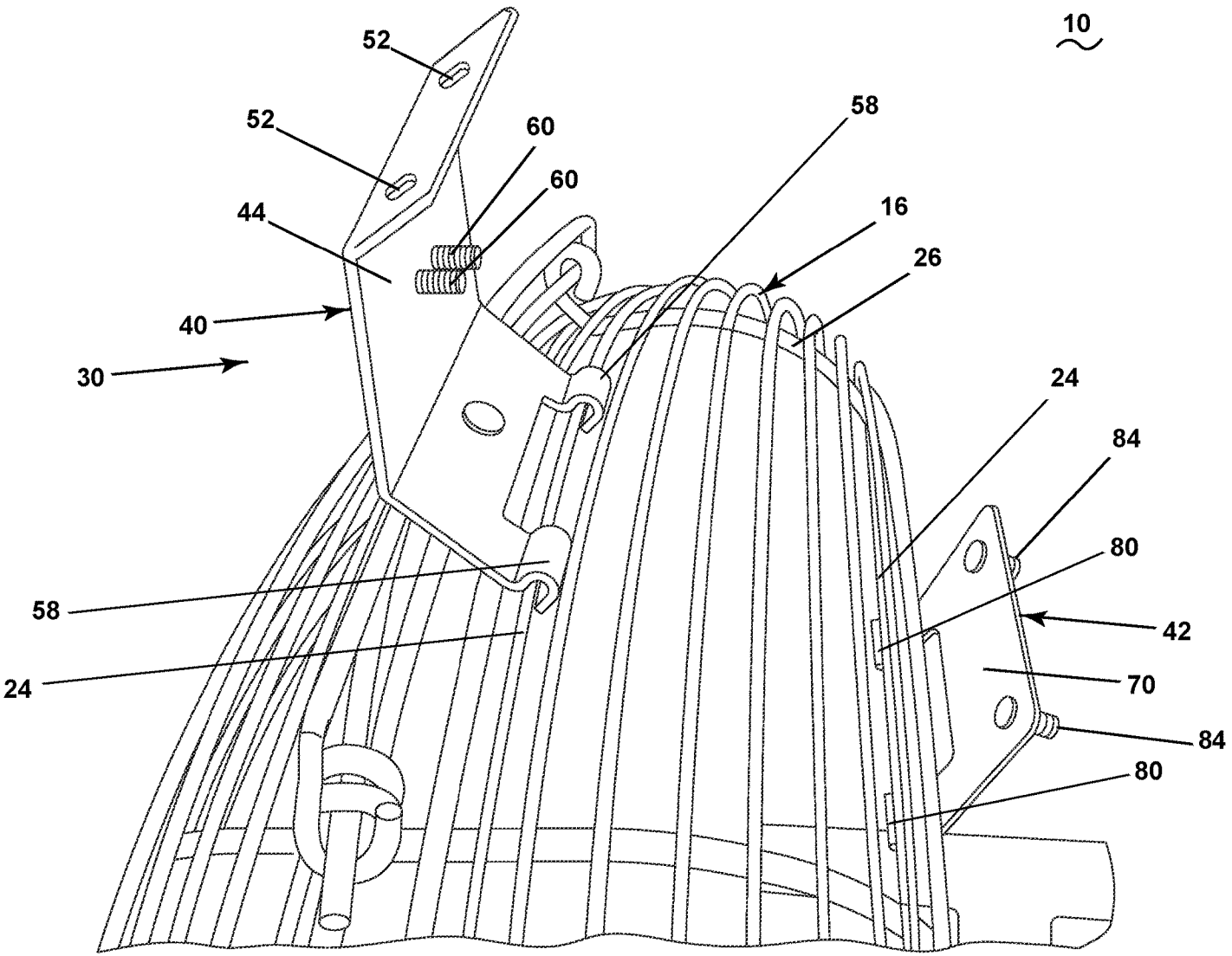
FIG. 4 is a first view illustrating a process of attaching the mount bracket of FIG. 1 to the cage, attaching the first portion and the second portion to the cage separately.

FIGS. 4-7 illustrate a method of attaching an accessory to a fan 10, with the figures illustrating the process of attaching the accessory to the fan 10. Referring to FIG. 4, the first portion 40 can connect to the bars 24 on the fan 10 at the hooks 58. Similarly, the second portion 42 can also connect to the bars 24 of the fan 10 with the hooks 80. The hooks 58, 80 provide for removably securing the first and second portions 40, 42 to the cage 16. As shown, the hooks 58, 80 can connect the first and second portion 40, 42 loosely to the cage 16, such that the first and the second portions 40, 42 can pivot about the cage 16 at the hooks 58, 80. More specifically, the shape of the hooks 58, 80 on both the first and second portions 40, 42 provides for attaching and pivoting the portions 40, 42 relative to the bars 24. Once pivoted, the hooks 58, 80 can secure the portions 40, 42 to the cage 16, and securing the portions 40, 42 locks the mount bracket 30 to the cage 16.

In one example, the first portion 40 can be positioned on the cage 16 such that the fixing extensions 60 can be arranged with one of the bars 24 or one of the ribs 26 positioned between the fixing extensions 60. In the example where one rib 26 is positioned between the fixing extensions 60, undesired circumferential motion of the mount bracket 30 is prevented. Optionally, it is contemplated that the first portion 40 can be secured to the second portion 42 and tightened to maintain the position of the mount bracket 30 on the cage 16. Similarly, where one bar 24 is positioned between the fixing extensions 60, movement of the mount bracket 30 up or down the cage is prevented. It is also contemplated that additional extensions can be included, as opposed to only two extensions or only one pair of extensions, to secure the mount bracket 30 to both one or more bars 24 and one or more ribs 26, preventing both vertical movement and circumferential movement of the mount bracket 30, and securing the position of any accessory coupled to the mount bracket 30. Furthermore, it should be appreciated that not all fan cages are rounded, and in such an event, the fixing extensions 60 can prevent undesired movement of the mount bracket 30 along the cage, regardless of the shape of the cage.

The second portion 42 can pivot about the hooks 80 such that the body 70 rests against the cage 16. Thereafter, the first portion 40 can also pivot about the hooks 58 such that the body 44 rests on the cage 16 and overlaps the second portion 42. The position of the first and second portions 40, 42 can be arranged such that the overlap of the first portion 40 over the second portion 42 aligns the apertures 52 of the first portion 40 onto the connectors 84 of the second portion 42. If such an alignment is not achieved, the positioning of the first portion 40 or the second portion 42 can be adjusted, such as by moving the hooks 58, 80 to another bar 24 or rib 26 on the cage 16, until the proper overlap among the first and second portions 40, 42 is achieved.

Figure 5:
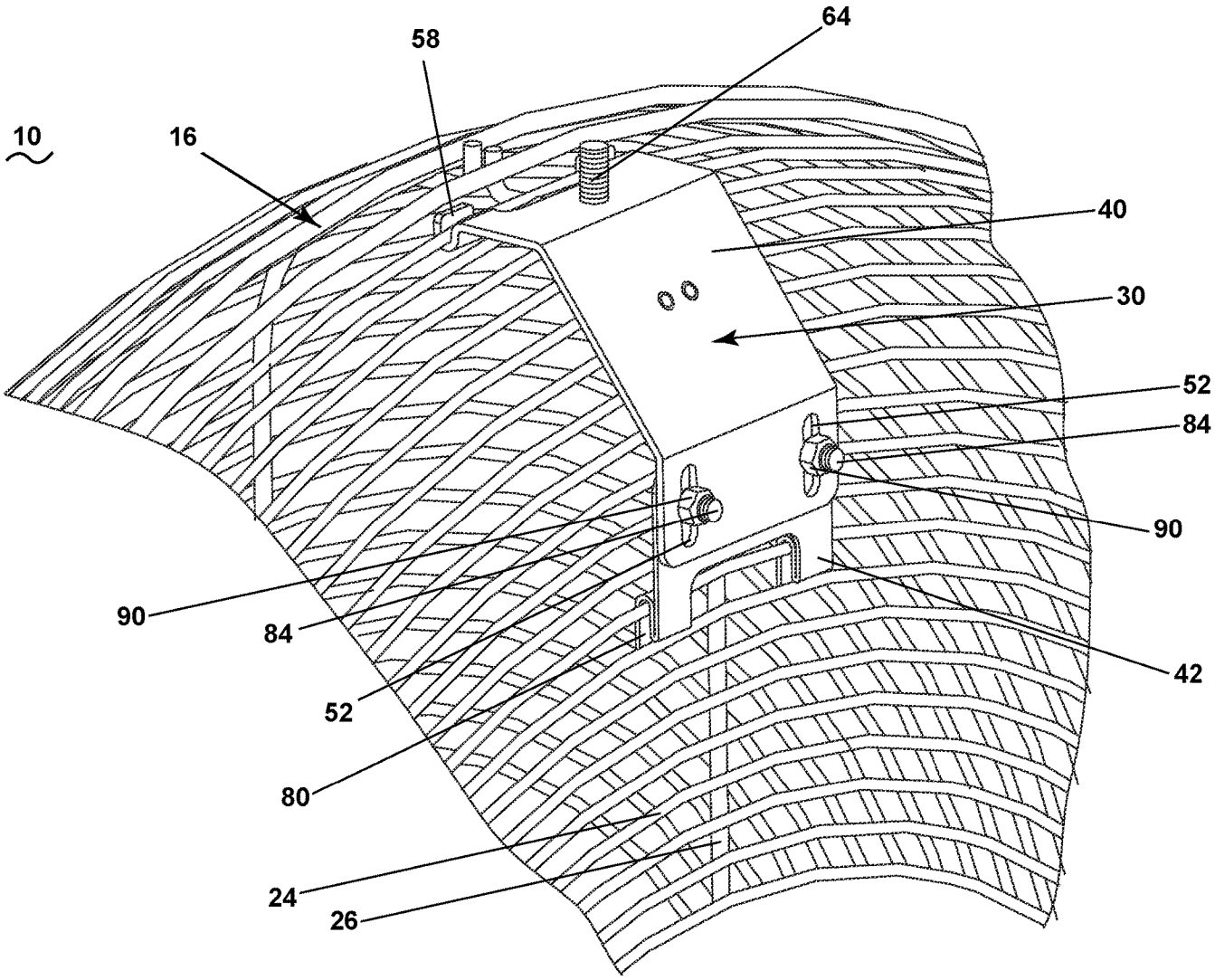
FIG. 5 is a second view of the process of attaching the mount bracket to the cage, continuing the process of attaching the bracket of FIG. 4, connecting the first portion of the mount bracket to the second portion.

Referring to FIG. 5, after aligning the first portion 40 with the second portion 42 such that the apertures 52 of the first portion are aligned with the connectors 84 of the second portion, the connectors 84 can extend through the apertures 52. A securing element, such as a nut 90 can be used to secure the connector 84 through the aperture 52, securing the first portion 40 to the second portion 42 and thereby securing the mount bracket 30 on the cage 16. More specifically, pivoting the first and second portion 40, 42 from the position of FIG. 4 to the position of FIG. 5 locks the first and section portions 40, 42 to the cage 16 at the bars 24 with the hooks 58, 80, and the nut 90 fixes the first and second portions 40, 42 in the position in FIG. 5, by preventing separation of the first portion 40 from the second portion 42. Preventing separation of the portions 40, 42 prevents the hooks 58, 80 from releasing from the bars 24.

Figure 6:
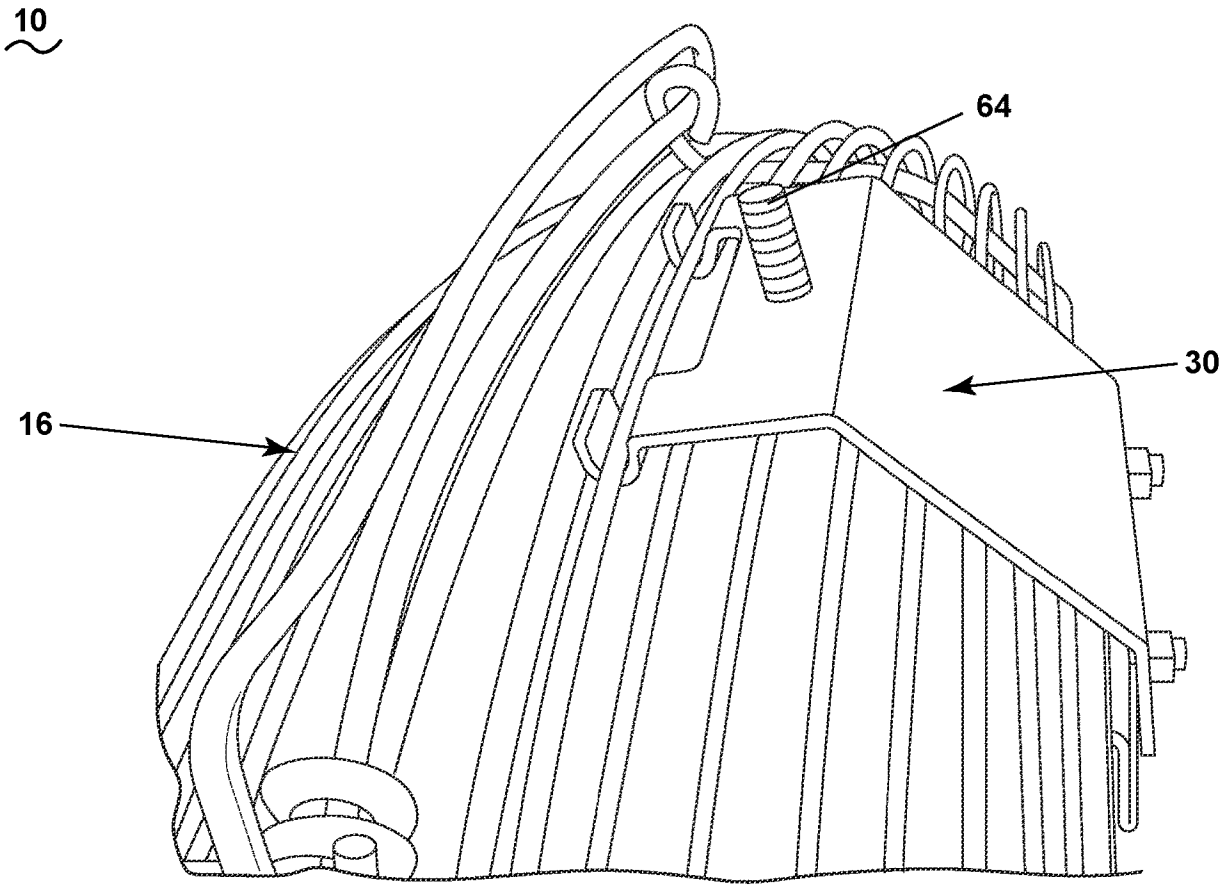
FIG. 6 is a third view of the process of attaching the mount bracket to the cage, continuing the process from FIG. 5, having the mount bracket secured to the cage with a fastener extension extending from the mount bracket.

Referring briefly to FIG. 6, with the mount bracket 30 in the locked position, the attachment feature 64 is extending radially outwardly, relative to the circumferential geometry of the cage 16. The accessory 32 can thread or otherwise attach to the mount bracket 30 at the attachment feature 64 for mounting the accessory 32 to the fan 10.

Figure 7:
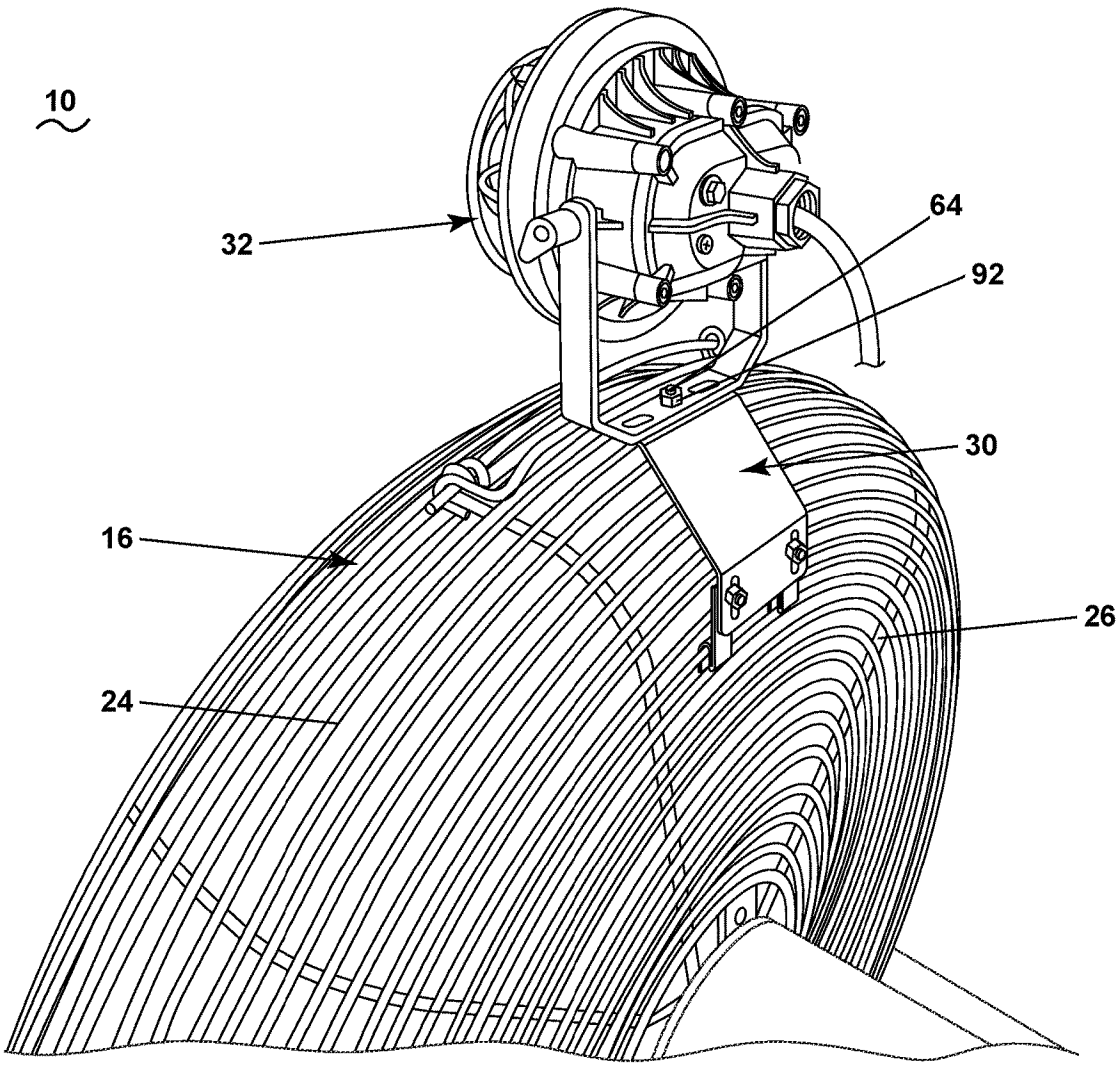
FIG. 7 is a fourth view of the process of attaching the mount bracket to the cage, continuing the process from FIG. 6, including attaching an accessory light to the mount bracket.

Referring to FIG. 7, the light accessory 32 is threadably mounted to the mount bracket 30 at the attachment feature 64, securing and positioning the light accessory 32 to the fan 10. In one example, a nut 92 can be used to thread to the attachment feature to secure the accessory 32 to the mount bracket 30. In this position, the accessory 32 is fixed to the mount bracket 30, and the mount bracket 30 is fixed to the cage 16. In this way, the mount bracket 30 provides for attaching different accessories to the fan 10 having the cage 16.

Additionally, in this position, the fixing extensions 60 secure movement of the mount bracket 30, preventing sliding of the mount bracket 30, and thus preventing sliding of the accessory 32 along the bars 24 or the ribs 26, or both.

The mount bracket 30 provides for facilitating and easing attachment of a myriad of accessories, such as a light or other element which may be desirable to attach to a fan, such as a misting accessory or heating accessory in non-limiting examples. Additionally, the two-part design of the mount bracket 30 provides for simple attachment, detachment, or movement of the mount bracket 30, without concern of the attached accessory moving, sliding, or falling after attachment. Furthermore, a desired position for an accessory can be maintained, such as for a light, which would be desirable to find an optimal position and keep the light in that position until a user wishes to move the position.

A method of connecting an accessory 32 to a fan 10 can include attaching a first portion 40 of the mount bracket 30 to the cage 16 of the fan 10 by connecting a first pair of hooks 58 on the first portion 40 to the cage 6, such as on the ribs 26 or bars 24 of the cage 16. The method can further include attaching a second portion 42 to the cage 16 by connecting a second pair of hooks 80 on the second portion 42 to a different rib 26 or bar 24 on the cage 16. It should be understood that the two portions 40, 42 can attach to the same bar 24 extending among a set of ribs 26.

The method can further include securing the first portion 40 to the second portion 42, and can include securing the accessory 32 to an attachment feature 64 extending from one of the first portion 40 or the second portion 42. The method can further include securing the first portion 40 to the second portion 42 by inserting at least one connector 84 on the second portion 42 into at least one complementary aperture 52 on the first portion 40. The method can further include securing the position of the first portion 40, and thus the mount bracket 30, with a pair of fixing extensions 60.

Although the embodiment of the present invention have been shown and described, it would be appreciated by those skilled in the art that changes may be made in these embodiments without departing from the principles and spirit of the invention. Although specific terms are employed herein, they are used in a generic and descriptive sense only and not for purposes of limitation.

This written description uses examples to disclose the invention, including the best mode, and to enable any person skilled in the art to practice the invention, including making and using any devices or systems and performing any incorporated methods. The patentable scope of the invention is defined by the claims, and can include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A mount bracket for mounting an accessory to a fan having a cage, the mount bracket comprising:

a first portion including at least one aperture and a first connector connecting the first portion to the cage to form a first pivot about which the first portion is pivoted relative to the cage;

a second portion including a second connector for connecting the second portion to the cage to form a second pivot about which the second portion is pivoted relative to the cage, and including at least one extension complementary to the at least one aperture; and an accessory attachment feature provided on one of the first portion and the second portion;

wherein the first portion is pivoted about the first pivot and the second portion is pivoted about the second pivot such that the first portion and second portion at least partially overlap and the extension is received through the aperture to couple the first portion and the second portion.

2. The mount bracket of claim 1, wherein the first connector comprises a pair of hooks and the second connector comprises a second pair of hooks.

3. The mount bracket of claim 2, wherein the pair of hooks and the second pair of hooks are configured to secure the mount bracket to the cage when first portion couples to the second portion.

4. The mount bracket of claim 1, wherein the accessory attachment feature is threaded, and extends from the first portion opposite away from the cage when the first portion couples to the cage.

5. The mount bracket of claim 4, further comprising a nut thread onto the accessory attachment feature to secure the accessory to the attachment feature.

6. The mount bracket of claim 1, wherein the accessory attachment feature is female threaded.

7. The mount bracket of claim 1, wherein the first portion includes a pair of fixing extensions configured to position on the cage.

8. The mount bracket of claim 7, wherein the pair of fixing extensions are spaced to position on opposite sides of a rib or a bar forming a portion of the cage.

9. The mount bracket of claim 1, wherein the first portion is separated into a first section, a second section, and a third section.

10. The mount bracket of claim 9, wherein the at least one aperture is provided on the first section.

11. The mount bracket of claim 10, wherein a pair of extensions are provided on the second section.

12. The mount bracket of claim 11, wherein the first connector extends from the third section, and the accessory attachment feature is provided on the third section.

13. The mount bracket of claim 9, wherein the first section and the second section, are relatively oriented at a first angle, and the second section and third section are relatively oriented at a second angle.

14. The mount bracket of claim 13, wherein the first angle and second angle are configured to conform the first portion to a curvature of the cage.

15. A fan comprising:

a motor assembly;

a set of blades rotatably driven by the motor assembly to move a volume of air about a space;

a cage encasing the set of blades, the cage including a set of ribs and a set of bars; and a mount bracket coupled to the cage, the mount bracket comprising:

a first portion including a first pair of hooks connected to at least one of the set of ribs or set of bars to form a first pivot about which the first portion pivots relative to the cage, with the first portion including a pair of apertures and an attachment feature, and a second portion including a second pair of hooks connected to at least one of the set of ribs or set of bars to form a second pivot about which the second portion pivots relative to the cage, with the second portion including a pair of extensions configured to secure to the first portion at the pair of apertures;

wherein the first portion is pivoted about the first pivot and the second portion is pivoted about the second pivot such that the first portion and second portion at least partially overlap and the pair of extensions are received through the corresponding pair of apertures to couple the first portion and the second portion;

wherein the attachment feature is configured to couple an accessory to the cage via the mount bracket.

16. The fan of claim 15, wherein the first portion includes a pair of fixing extensions configured to position on the cage.

17. The fan of claim 16, wherein the pair of extensions are spaced to position on opposite sides of one rib of the set of ribs or one bar of the set of bars.

18. The fan of claim 15, wherein the first portion is separated into a first section, a second section, and a third section, whereby the first section is offset from the second section by a first angle, and the second section is offset from the third section by a second angle.

19. A method of connecting an accessory to a fan with a mount bracket, the method comprising:

attaching a first portion to a cage of the fan, by connecting a first pair of hooks on the first portion to a rib of the cage to form a first pivot about which the first portion is pivoted;

attaching a second portion to the cage of the fan, by connecting a second pair of hooks on the second portion to a different rib of the cage to form a second pivot about which the second pivot is pivoted;

securing the first portion to the second portion once the first portion and second portion are in at least a partially overlapping orientation after pivoting about the corresponding first pivot and second pivot; and securing the accessory to an attachment feature extending from the first portion.

20. The method of claim 19, wherein securing the first portion to the second portion includes inserting at least one connector on the second portion into at least one complementary aperture on the first portion.

21. The method of claim 19, further comprising securing a position of the first portion with a pair of fixing extensions.

* * * * *